US012258159B2

(12) United States Patent
Rivola et al.

(10) Patent No.: US 12,258,159 B2
(45) Date of Patent: Mar. 25, 2025

(54) MACHINE FOR MAKING CAPSULES

(71) Applicant: I.M.A. INDUSTRIA MACCHINE AUTOMATICHE S.p.A., Ozzano Dell'Emilia (IT)

(72) Inventors: Sauro Rivola, Ozzano Dell'Emilia (IT); Cristian Betti, Ozzano Dell'Emilia (IT); Mauro Bianchi, Ozzano Dell'Emilia (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 291 days.

(21) Appl. No.: 17/626,676

(22) PCT Filed: Jul. 15, 2020

(86) PCT No.: PCT/IB2020/056648
§ 371 (c)(1),
(2) Date: Jan. 12, 2022

(87) PCT Pub. No.: WO2021/024055
PCT Pub. Date: Feb. 11, 2021

(65) Prior Publication Data

US 2022/0250778 A1 Aug. 11, 2022

(30) Foreign Application Priority Data

Aug. 5, 2019 (IT) ..... 102019000013971

(51) Int. Cl.
*B65B 29/02* (2006.01)
*B65B 1/08* (2006.01)
(Continued)

(52) U.S. Cl.
CPC ..... *B65B 29/022* (2017.08); *B65B 1/08* (2013.01); *B65B 43/50* (2013.01); *B65B 43/60* (2013.01); *B65B 55/24* (2013.01); *B65B 57/02* (2013.01)

(58) Field of Classification Search
CPC ..... B65B 29/022; B65B 1/08; B65B 43/50; B65B 43/60; B65B 55/24; B65B 57/02
See application file for complete search history.

(56) References Cited

U.S. PATENT DOCUMENTS 4,959,943 A * 10/1990 Yamamoto ..... A61J 3/074 53/900
5,743,069 A * 4/1998 Ansaloni ..... A61J 3/074 53/167
(Continued)

FOREIGN PATENT DOCUMENTS

CN 201882272 U 6/2011
CN 104955745 A 9/2015
(Continued)

OTHER PUBLICATIONS

International Search Report and Written Opinion dated Sep. 14, 2020 from International Patent Application No. PCT/IB2020/056648.
(Continued)

*Primary Examiner* — Joshua G Kotis
*Assistant Examiner* — Scott A Howell
(74) *Attorney, Agent, or Firm* — SHUTTLEWORTH & INGERSOLL, PLC; Timothy J. Klima

(57) ABSTRACT

A machine for making capsules containing powder product including a plurality of processing stations configured for performing respective processes for making capsules and movement means configured for conveying said capsules along a processing path extending through the plurality of processing stations. The movement means include a transfer
(Continued)

drum and a plurality of units each designed to receive at least one capsule body. Moreover, each unit is coupled to a lateral surface of the transfer drum and is configured to rotate relative to the lateral surface about a respective orientation axis parallel to an axis of rotation of the transfer drum.

12 Claims, 2 Drawing Sheets

(51) Int. Cl.

| | |
|---|---|
| ***B65B 43/50*** | (2006.01) |
| ***B65B 43/60*** | (2006.01) |
| ***B65B 55/24*** | (2006.01) |
| ***B65B 57/02*** | (2006.01) |

(56) References Cited

U.S. PATENT DOCUMENTS

| | | | | |
|---|---|---|---|---|
| 8,539,743 | B2 * | 9/2013 | Rapparini | B65B 31/028 53/511 |
| 9,549,876 | B2 * | 1/2017 | Runft | A61J 3/074 |
| 10,279,938 | B2 * | 5/2019 | Cavazza | B65B 41/06 |
| 10,472,105 | B2 * | 11/2019 | Castellari | B65B 29/022 |
| 10,472,185 | B2 * | 11/2019 | Rea | B65B 43/44 |
| 10,633,172 | B2 * | 4/2020 | Rapparini | B65B 29/02 |
| 10,889,394 | B2 * | 1/2021 | Ghiotti | B65B 65/003 |
| 11,548,667 | B2 * | 1/2023 | Cittadino | B65B 61/26 |
| 11,745,906 | B2 * | 9/2023 | Bertash | B65B 1/36 53/268 |
| 2011/0016834 | A1 * | 1/2011 | Rapparini | B65B 29/022 53/510 |
| 2015/0027085 | A1 * | 1/2015 | Rea | B65B 29/022 53/389.1 |
| 2016/0355286 | A1 * | 12/2016 | Cavazza | B29C 66/849 |
| 2017/0121044 | A1 * | 5/2017 | Castellari | B65B 7/01 |
| 2017/0275085 | A1 * | 9/2017 | Rapparini | B65B 29/02 |

FOREIGN PATENT DOCUMENTS

| | | | |
|---|---|---|---|
| CN | 205819682 | U | 12/2016 |
| EP | 2135810 | A1 | 12/2009 |
| EP | 3222558 | A1 | 9/2017 |
| JP | H024601 | A | 1/1990 |
| JP | 2001278202 | A | 10/2001 |
| WO | 2013144835 | A1 | 10/2013 |
| WO | 2015121838 | A2 | 8/2015 |
| WO | 2015177690 | A1 | 11/2015 |

OTHER PUBLICATIONS

Chinese Office Action dated Nov. 29, 2022 from counterpart Chinese Patent Application No. 202080055836.5.

Japanese Office Action dated Feb. 9, 2024 for counterpart Japanese Patent Application No. 2022-507567.

* cited by examiner

MACHINE FOR MAKING CAPSULES

This application is the National Phase of International Application PCT/IB2020/056648 filed Jul. 15, 2020, which designated the U.S.

This application claims priority to Italian Patent Application No. 102019000013971 filed Aug. 5, 2019, which application is incorporated by reference herein.

TECHNICAL FIELD

This invention relates to the technical sector of packaging of single-use containers containing a dose of preparation for food products (in particular for beverages), for example pods or capsules for coffee, tea or other preparations for extraction.

In particular, this invention relates to a machine and a method for making capsules containing powder product.

BACKGROUND ART

The diffusion of single-use capsules and pods in particular for extraction beverages is in continuous expansion thanks to the speed, convenience and simplicity of use of these type of products, which are particularly appreciated for their efficiency and speed of use in working environments and used increasingly also in domestic environments.

The increasing demand has therefore made it necessary to continuously optimise the production processes, in particular with regard to a reduction in the processing times necessary for making the finished product.

Moreover, from a logistics point of view it is necessary to optimise the use of the available spaces, thus reducing the overall dimensions of the machines designed for making the capsules.

According to a prior art solution in this context, the capsules are conveyed by a transfer drum along an at least partly circular trajectory extending in a succession of processing stations.

However, this solution has drawbacks which make it not very efficient with low performance levels.

In fact, in the particular production context of the capsules there is a succession of processing steps which must necessarily be performed keeping them in position in specific positions relative to the processing stations.

For example, the above is particularly true with regard to the process for filling the capsules with the powder product which it must contain; if the capsule is incorrectly inclined when the powder product is transferred, part of it would inevitably fall outside, resulting in waste and insufficient filling of the capsule.

For this reason, although prior art devices are able to satisfy the needs of compactness and speed of movement of the capsules, they are extremely rigid and not very functional, since only a limited angular portion of the path for conveying the capsules can be effectively used for performing specific production steps.

In other words, the logistics management of the space available for installing the various processing stations on the machine is constrained by the specific orientation which the capsules adopt during their conveying.

Aim of the Invention

In this context, the technical purpose which forms the basis of the invention is to provide a machine and a method for making capsules which overcomes at least some of the above-mentioned drawbacks of the prior art.

In particular, the aim of the invention is to provide a machine and a method for making capsules which are particularly compact and at the same time versatile and easy to use.

The technical purpose indicated and the aims specified are substantially achieved by a machine and a method for making capsules, comprising the technical features described in one or more of the accompanying claims.

The invention describes a machine for making capsules containing powder product comprising a plurality of processing stations configured for performing respective processes for making capsules containing powder product and movement means configured for conveying said capsules along a processing path extending through the plurality of processing stations.

The movement means comprise a transfer drum and a plurality of units each designed to receive at least one capsule body.

Moreover, each unit is coupled to a lateral surface of the transfer drum and is configured to rotate relative to the lateral surface about a respective orientation axis parallel to an axis of rotation of the transfer drum.

Advantageously, the machine according to the invention allows the individual units to be oriented autonomously without being constrained by the position adopted by the various portions of the lateral surface of the drum on which they are situated, allowing the alignment with the individual processing stations to be optimised.

The invention also relates to a method for making capsules which comprises a step of conveying a succession of units along a processing path which extends through a plurality of processing stations by means of a transfer drum.

Preferably, each unit is coupled to a lateral surface of the transfer drum and is configured to rotate relative to the lateral surface about a respective orientation axis parallel to an axis of rotation of the transfer drum.

The method also comprises selectively rotating at least one unit relative to the lateral surface of the transfer drum as a function of its angular position.

Advantageously, the method according to the invention makes it possible to manage the movement of the individual units autonomously and in such a way that these units are always oriented in an optimum manner relative to the processing stations along the entire working path.

BRIEF DESCRIPTION OF THE DRAWINGS

Further features and advantages of the present invention are more apparent in the detailed description below, with reference to a preferred, but non-exclusive embodiment of a machine and a method for making capsules, as illustrated in the accompanying drawings, in which.

DETAILED DESCRIPTION OF PREFERRED EMBODIMENTS OF THE INVENTION

In the accompanying drawings, the numeral 1 denotes generically a machine for making capsules "C" containing powder product "R", indicated below simply as the machine 1.

The machine 1 according to the invention comprises a plurality of processing stations 2 and movement means 3 configured for conveying the capsules "C" during processing through the various processing stations 2.

By way of example, the capsules "C" may comprise a capsule body made by moulding a metallic material, in particular aluminium or an aluminium alloy.

Figure 3:
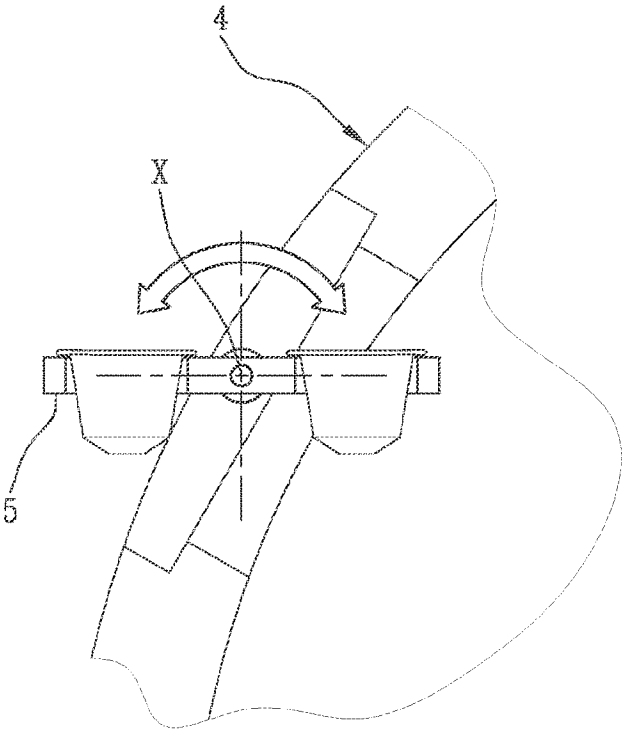
FIG. 3 shows a detail of the machine of FIG. 2.
Figure 1:
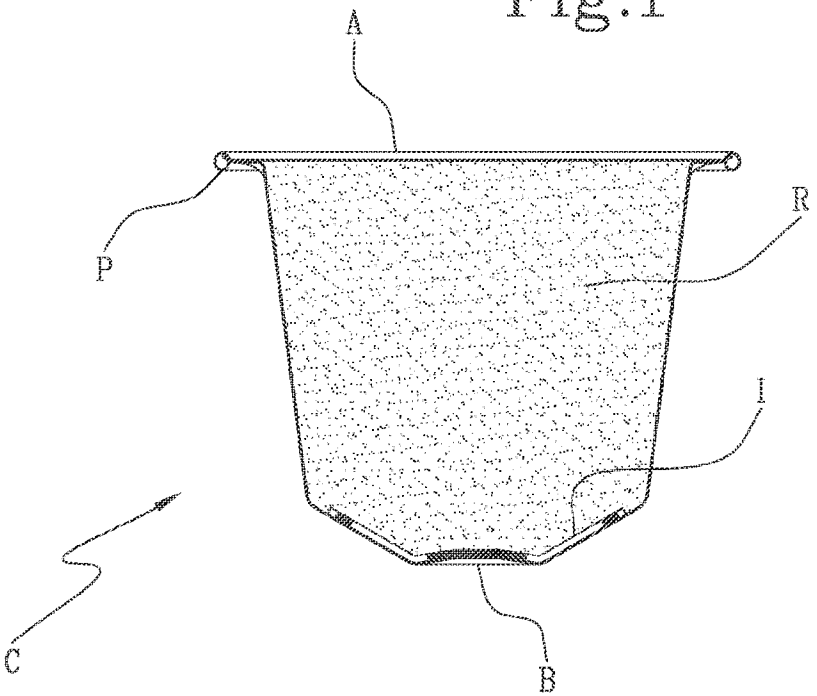
FIG. 1 shows the capsule which can be processed using the machine and/or the method according to the invention.

As may be seen in FIG. 1, the capsules "C" may have the shape of a substantially truncated cone shaped solid of revolution, with a slight taper and vertex positioned at the bottom, closed at the bottom by a circular base "B", equipped at the top with a circular opening "A", and equipped with an edge wall "P" defined by a circular crown lying horizontally.

One or more inserts "I" may also be inserted inside the capsule "C".

In general, the processing stations 2 are configured to perform respective processes aimed at making capsules "C" containing powder product "R" in a respective predetermined processing time.

By way of example and as described in more detail below, the machine 1 may comprise a plurality of processing stations 2 including at least one between: a feeding station 2*a* configured for feeding the capsule bodies; a filling and dosing station 2*b* wherein the powder product "R" is dosed and introduced inside the capsule body; a station 2*c* for making a closing cover, and a sealing station, not illustrated in the accompanying drawings, wherein the cover is stably connected to the capsule body.

The plurality of processing stations 2 may also comprise at least one insertion station 2*d* configured for applying to the capsule body a respective insert "I", such as, for example, an insert made of filtering material.

The plurality of processing stations 2 may also comprise at least one compression and cleaning station 2*e* designed in particular for cleaning the edge portion "P" of the capsule body after the insertion inside it of the powder product "R".

The movement means 3 are, on the other hand, configured for conveying the capsules "C" along a processing path extending through the plurality of processing stations 2.

In other words, the processing path extends at the machine 1, in such a way as to allow each capsule "C" to be transported at or also inside the various processing stations 2 to allow the latter to operate on them.

Structurally, the movement means 3 comprise a transfer drum 4 and a plurality of units 5 each designed to receive at least one respective capsule body.

In particular, each unit 5 is coupled to the lateral surface of the transfer drum 4, in such a way that the rotation of the transfer drum 4 allows them to be conveyed along the working path which therefore extends along a substantially circular trajectory, in particular along a circular arc.

More specifically, each units 5 is coupled to a lateral surface of the transfer drum 4 and configured to be positioned relative to said lateral surface in such a way as to adopt a predetermined orientation relative to said transfer drum 4.

Moreover, each unit 5 is configured to rotate with respect to the lateral surface of the transfer drum 4 on which it is mounted, rotating about a respective a respective orientation axis "X" parallel to the axis of rotation "Y" of the transfer drum 4.

Preferably, each orientation axis "X" lies at the lateral surface of the transfer drum 4.

In other words, each unit is connected in an idle fashion to the transfer drum 4 at its lateral surface, in such a way as to be adjustable so that it can be suitably aligned with each processing station 2 according to their specific operating requirements.

For example, at a filling station, wherein the powder product R" must be introduced inside the capsule body, it may be necessary for the unit to adopt a substantially horizontal configuration, in such a way as to allow the capsule body to be completely filled without the risk that the powder product "R" falls outside it.

Advantageously, the ability to orient the individual units provides the machine 1 with a high versatility and efficiency; in fact, it is the individual units which are suitably oriented relative to the individual processing stations 2, with it no longer being necessary to position the processing stations 2 as a function of the orientation of the individual units 5 along the processing path and only at those points where the orientation is compatible with the performance of a specific processing step.

Preferably, the transfer drum 4 is configured to adopt a succession of different angular positions wherein at least one unit 5 in positioned at a respective processing station 2.

In other words, the transfer drum 4 may be set in rotation in discrete steps in such a way that in successive steps a predetermined unit 5 is moved along the processing path and passes one after another through the various processing stations 2 which form part of the machine 1.

In this way, the capsule bodies after being fed to the machine 1 are in sequence transferred to the units 5, processed and finally extracted from the units 5 in such a way as to be moved towards further machines positioned downstream and designed, for example, to perform a grouping and packaging of the capsules C.

The units 5 may thus adopt different orientations relative to the lateral surface of the transfer drum 4 as a function of the specific angular position of the transfer drum 4 and therefore as a function of the processing station 2 at which they are in that specific angular position.

In other words, for each angular position which can be adopted by the transfer drum 4, it is known which units 5 are located at which processing stations 2, so it is possible to associate with each unit 5 a specific orientation which the unit 5 must adopt and which is determined as a function of the angular position adopted at that moment by the transfer drum 4.

Preferably, the units are positioned radially about the axis of rotation "Y" of the transfer drum 4 and are equidistant from each other (at a constant spacing) on its lateral surface.

In this way, the transfer drum 4 can be moved according to successive steps in which its angular position is always modified by a predetermined constant value.

Preferably, each unit 5 comprises a damping device configured to reduce the vibrations to which it is subjected when the transfer drum 4 varies its angular position (rotates relative to the transfer axis Y).

In fact, the step-by-step movement of the transfer drum 4 applies a continuous acceleration and deceleration to the individual units and to the capsule bodies contained therein.

The presence of the damping devices therefore prevents this non-continuous movement from causing an undesired deterioration of the capsule body which is being processed whilst it passes through the various production steps, or an accidental movement of the elements inserted inside it (whether it is the powder product "R" or further inserts "I").

Advantageously, in addition to the shock absorbing device which is configured as a passive device, each unit 5 may further comprise a compensating device which, on the other hand, acts on the respective unit 5 for modifying the inclination in such a way as to compensate for an acceleration generated when the transfer drum 4 varies its angular position.

In other words, the compensating device guarantees that the unit 5 maintains a correct orientation whilst it is conveyed between one processing station 2 and the next.

For example, after the powder product "R" has been introduced into the capsule body it is necessary to guarantee that the latter is not inclined before applying at least one retaining element such as, for example, the cover, therefore the compensating device rotates (for example, continuously) the unit 5 whilst it is conveyed along the semi-circular trajectory determined by the transfer drum 4 in such a way as to keep it in a substantially horizontal configuration along the stretch in question.

Each unit 5 also has at least one suction hole, in particular at least one suction hole for each capsule body which its is configured to receive, which is operatively connectable to a suction source.

By means of the suction holes it is therefore possible to generate a negative pressure which promotes the correct retaining of the capsule bodies inside the respective units 5 along the entire processing path and independently of the specific orientation which they adopt for aligning with the various processing stations 2.

The machine 1 also comprises a detection system 6 associated with at least one processing station 2 for assessing the correct execution of the processes of the processing station 2 (more specifically, for assessing the correct positioning of at least one of said units 5 relative to one of said processing stations 2).

More specifically, the detection system comprises at least one sensor (of the optical, mechanical, electromagnetic or other type) which inspects the capsule bodies at the outfeed from the respective processing station 2, in such a way as to detect any defects or imperfections due to the process or to the raw and/or semi-finished materials used for the process which can determine the need to reject a predetermined capsule body.

According to a particular embodiment, illustrated schematically in FIG. 2, the machine 1 comprises a station 2*a* for feeding the capsule body, made, for example, by a conveyor belt which receives the capsule bodies from a process upstream of the machine 1 and conveys them in a plane located substantially below the transfer drum 4.

Once the capsule bodies arrive at the transfer drum they are received in respective units 5 and retained, for example, thanks to the negative pressure generated by the suction source and exerted on the capsule bodies through the suction ducts.

Downstream of the feed station 2*a* there is an insertion station 2*d*.

Said insertion station 2*d* comprises a first element 2*d* for inserting an insert I and a second element 2*d* for inserting an insert I with a dosing station 2*b* interposed between them.

More in detail, downstream of the feed station 2*a* there is a first insertion station in which a first insert "I" is introduced inside the capsule body. In said station there is the first insertion element.

The insertion station 2*d* may, for example, comprise a path for unwinding a reel of web made of material designed to make the insert "I" and one or more punches acting along the path and configured to engage the web, detaching a succession of inserts "I", promoting the insertion inside the capsule body.

Figure 2:
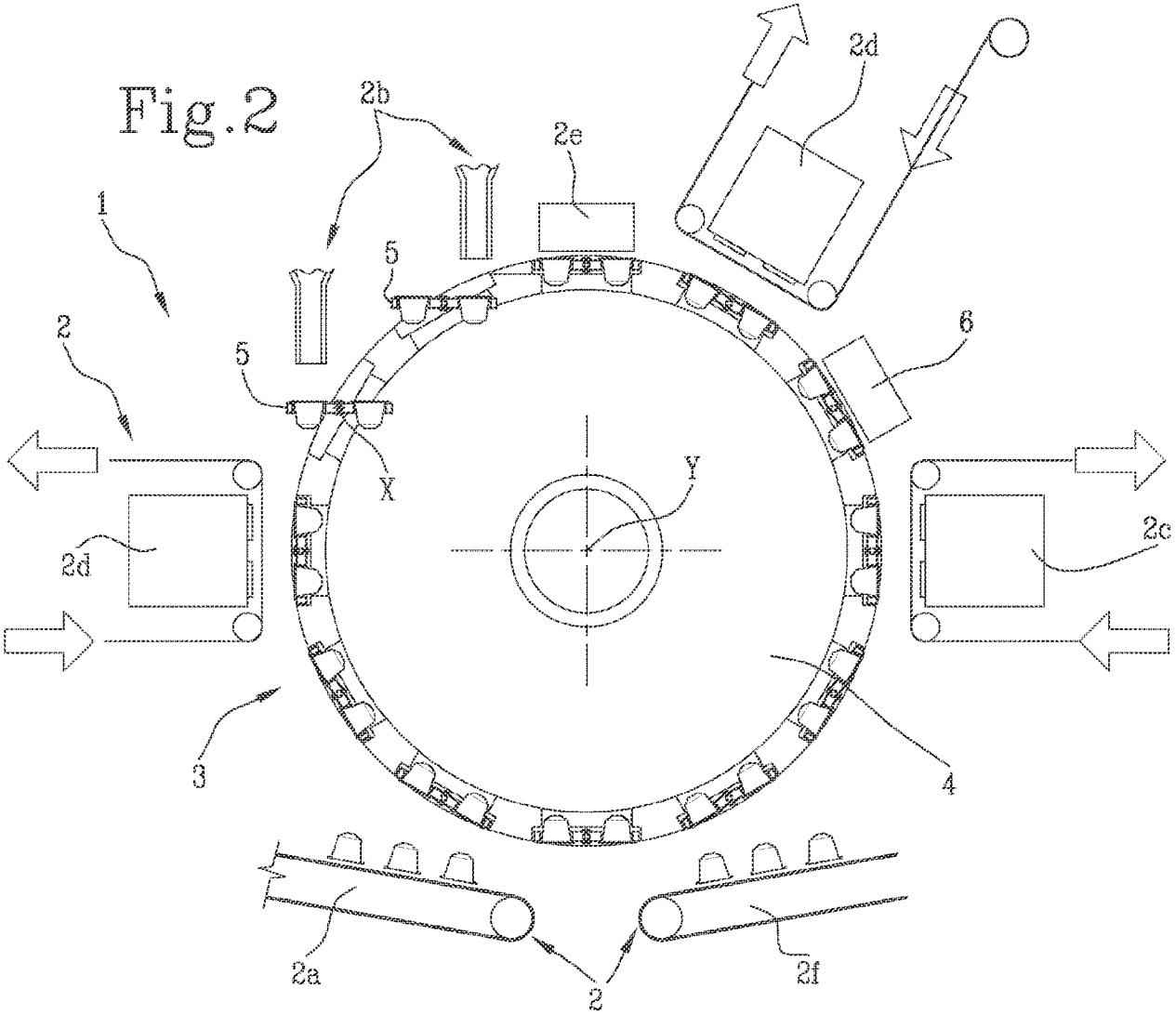
FIG. 2 shows a machine for making capsules according to the invention.

Downstream of the first insertion station 2*d* there is at least one station 2*b* for dosing the powder product "R", two dosing stations 2*b* in the specific configuration shown by way of example in FIG. 2.

In particular, simultaneously with the rotation of the transfer drum 4 which carries a predetermined unit 5 from the first insertion station 2*d* to the at least one dosing station 2*b*, there is also a relative rotation of the unit 5 relative to the lateral surface of the transfer drum 4, in such a way as to bring it into a substantially horizontal configuration, which allows the powder product "R" to be inserted inside the capsule body in a correct manner.

In general, in each of the processing stations 2 it is possible for the units 5 to adopt different orientations depending on which orientation is most advantageous in terms of managing the positioning of the individual processing stations 2 in the machine 1 and/or optimising the performance of the various processes.

Downstream of the at least one dosing station 2*b* there is a compression and cleaning station 2*e* in which any portions of the powder product "R" which have accidentally remained outside the capsule body, in particular placed on the edge portion "P" and which could therefore adversely affect the subsequent coupling of the cover to the capsule body, are eliminated.

Downstream of the compression and cleaning station 2*e* there is a second insertion station 2*d* which allows the application of a further insert "I" which will therefore be positioned above the powder product "R", facilitating the containment inside the capsule body.

In the specific example shown in FIG. 2, at the second insertion station 2*d*, the units 5 are again aligned with the lateral surface of the transfer drum 4.

In other words, the structure shown in FIG. 2 allows inserts "I" to be applied inside the capsule body in such a way that the powder product "R" is enclosed between them.

Downstream of the second insertion station 2*d* there is a detection system 6 which controls the correct application of the second insert "I" and consequently the correct retaining of the powder product "R" by the latter.

Downstream of the detection system 6 there is a station 2*c* for making a closing cover, which may or may not coincide with the sealing station in such a way that inside the station the cover is not only made and applied to the capsule body, but also connected to it.

According to one aspect, the sealing station 2*c* comprises means for making a cover for closing said capsule body.

In particular, the station 2*c* for making the closing cover may comprise a path for unwinding a roll of web made of material designed to make the cover and one or more punches acting along the path and configured to engage the web, detaching a succession of covers and promoting the application and, if necessary, also the sealing to the edge portion "P" of the capsule body.

Downstream of the making station 2*c* there is an evacuation station 2*f* by means of which the capsules "C" made by the machine 1 are transferred to further production processes situated downstream of the machine 1.

In particular, the evacuation station may be embodied by a conveyor belt positioned below the transfer drum 4, in such a way that by simply interrupting the fluid connection between the suction holes and the suction source of a predetermined unit it is possible to make the capsules "C" held by the unit fall onto the conveyor belt simply under the effect of the force of gravity, which is no longer opposed by the negative pressure generated by the suction source.

Advantageously, the invention achieves the preset aims overcoming the drawbacks of the prior art by providing the user with a machine for making capsules "C" containing powder products "R", which is compact and versatile and which guarantees a correct movement of the capsule bodies along the processing path.

The invention also relates to a method for making capsules "C" containing powder product "R", preferably which can be performed using a machine 1 made as described above.

According to one aspect, the method comprises a step of preparing a transfer drum 4 configured to rotate about a transfer axis Y, and a plurality of units 5 each designed to receive at least one capsule body, each unit 5 of said plurality of units 5 being coupled to a lateral surface of the transfer drum 4.

According to another aspect, the method comprises the step of moving said transfer drum 4 so as to move said units 5.

According to another aspect, the method comprises the step of selectively rotating at least one unit 5 relative to the lateral surface of the transfer drum 4, so as to adopt a predetermined orientation with respect to said transfer drum 4.

According to another aspect, the method also comprises at least one of the following steps:

dosing 2*b* a powder product R inside said capsule body;

sealing a cover on said capsule body;

said dosing and sealing steps are performed when said unit 5 adopts a predetermined respective angular position relative to the lateral surface of the transfer drum 4.

Further aspects of the method according to the invention are described below.

The method comprises conveying a succession of units 5, each of which designed to receive at least one capsule body.

In particular, the units 5 are conveyed along a processing path extending through a plurality of processing stations 2 by means of a transfer drum 4.

As described in more detail above relative to the machine 1, the units 5 are coupled to a lateral surface of the transfer drum 4 and configured to rotate relative to it about the respective orientation axis "X".

The units 5 are then made to pass along the processing path through the various processing stations 2 in such a way that the capsule bodies can be processed for making the capsules "C".

During the movement of the units 5 along the working path, at least one unit 5 is selectively rotated relative to the lateral surface of the transfer drum 4 as a function of an angular position of the latter.

Preferably, the at least one unit 5 is rotated in such a way as to adopt a substantially horizontal configuration along at least one stretch of the processing path.

In this way, the units 5 can be selectively oriented according to the specific operating needs of the individual processing stations 2.

Advantageously, the invention achieves the preset aims overcoming the drawbacks of the prior art by providing the user with a method for making capsules which makes it possible to optimise the management of the resources available, in particular relative to the use and the positioning of the various processing stations 2.

The invention claimed is:

1. A machine for making a capsule containing a powder product comprising:

a plurality of processing stations configured to perform respective processes for making capsules containing powder product;

a transport mechanism configured for conveying said capsules along a curvilinear processing path extending through the plurality of processing stations and comprising a transfer drum, configured to rotate about a substantially horizontal transfer axis, and a plurality of transport units configured to each receive at least one capsule body;

each transport unit being coupled to a lateral surface of the transfer drum, and said plurality of processing stations comprising a dosing station configured to dose the powder product in said at least one capsule body and a sealing station configured to seal a cover too said at least one capsule body, wherein each transport unit is configured to be moved relative to said lateral surface while said transfer drum rotates and to adapt a position of the transported at least one capsule body, so that the at least one capsule body assumes a predetermined angular orientation relative to each of said plurality of processing stations; and the plurality of processing stations being positioned along a circular working path defined by the transfer drum.

2. The machine according to claim 1, wherein the transfer drum is configured to adopt a succession of angular positions wherein in each of said angular positions at least one transport unit is positioned at a respective processing station.

3. The machine according to claim 1, wherein each transport unit comprises a damping device configured to reduce vibrations to which said transport unit is subjected when the transfer drum rotates.

4. The machine according to claim 1, wherein each transport unit comprises a compensating device configured to modify an inclination of said transport unit to offset a movement caused by an acceleration generated when the transfer drum starts to rotate.

5. The machine according to claim 1, wherein each transport unit rotates about a respective orientation axis parallel to the transfer axis of the transfer drum.

6. The machine according to claim 1, wherein each transport unit includes at least one suction hole operatively connectable to a source of suction.

7. The machine according to claim 1, and further comprising a detection system positioned at at least one processing stations for assessing a correct positioning of at least one of said transport units relative to the at least one of said processing stations.

8. The machine according to claim 1, wherein the sealing station comprises a mechanism for making a cover for closing said at least one capsule body.

9. The machine according to claim 1, wherein the plurality of processing stations also comprises:

a feeding station for feeding the at least one capsule body;

an insertion station for inserting an insert inside said at least one capsule body.

10. The machine according to claim 9, wherein said insertion station comprises a first element for inserting a first insert and a second element for inserting a second insert with said dosing station interposed between them.

11. The machine according to claim 9, wherein said insert is made of filter material.

12. A method for making capsules comprising the steps of:

providing a plurality of processing stations configured to perform respective processes for making capsules containing powder product;

providing a transfer drum configured to rotate about a substantially horizontal transfer axis, and a plurality of transport units each configured to receive at least one capsule body, each transport unit of said plurality of transport units being coupled to a lateral surface of the transfer drum;

moving said transfer drum to move said transport units;

dosing a powder product inside said at least one capsule body;

sealing a cover on said at least one capsule body;

wherein each transport unit is moved relative to said lateral surface while said transfer drum rotates, to adapt a position of the transported said at least one capsule body, so that the at least one capsule body assumes a predetermined angular orientation relative to each of said plurality of processing stations;

the dosing and sealing steps being performed when said transport unit adopts a predetermined angular position relative to the lateral surface of the transfer drum; and the plurality of processing stations being positioned along a circular working path defined by the transfer drum.

* * * * *